United States Patent [19]

Bianchi et al.

[11] 4,434,629

[45] Mar. 6, 1984

[54] WASHING MACHINE WITH ELECTROCHEMICAL CELL

[75] Inventors: Giuseppe Bianchi, Milan; Roberto Sburlino, Udine, both of Italy

[73] Assignee: Industrie Zanussi S.p.A., Pordenone, Italy

[21] Appl. No.: 431,077

[22] Filed: Sep. 30, 1982

[30] Foreign Application Priority Data

Dec. 14, 1981 [IT] Italy ..... 45738 A/81

[51] Int. Cl.[3] ..... D06F 35/00

[52] U.S. Cl. ..... 68/13 A; 68/207; 134/36; 134/100; 134/109; 422/29

[58] Field of Search ..... 68/13 A, 207; 134/36, 134/100, 101, 102, 109; 422/29, 37

[56] References Cited

U.S. PATENT DOCUMENTS 3,339,737 9/1967 Kiscellus et al. ..... 68/13 A X
4,402,197 9/1983 Groult et al. ..... 68/13 A X

FOREIGN PATENT DOCUMENTS

WO79/00346 6/1979 PCT Int'l Appl. .
WO81/01863 7/1981 PCT Int'l Appl. .

*Primary Examiner*—Philip R. Coe
*Assistant Examiner*—Frankie L. Stinson
*Attorney, Agent, or Firm*—Wenderoth, Lind & Ponack

[57] ABSTRACT

A laundry washing machine includes a washing tube, a water supply an a decalcifier for receiving water from the water supply and for discharging softened water. A metering tank is at an upper position in the machine to receive softened water from the decalcifier. A brine tank at a lower position in the machine receives softened water from the metering tank and generates brine. An electrochemical cell is provided to generate chlorine gas. Valves are provided to selectively pass brine from the brine tank to the electrochemical cell or to the decalcifier. Chlorine gas generated in the cell is absorbed and then passed to the washing tube.

9 Claims, 1 Drawing Figure

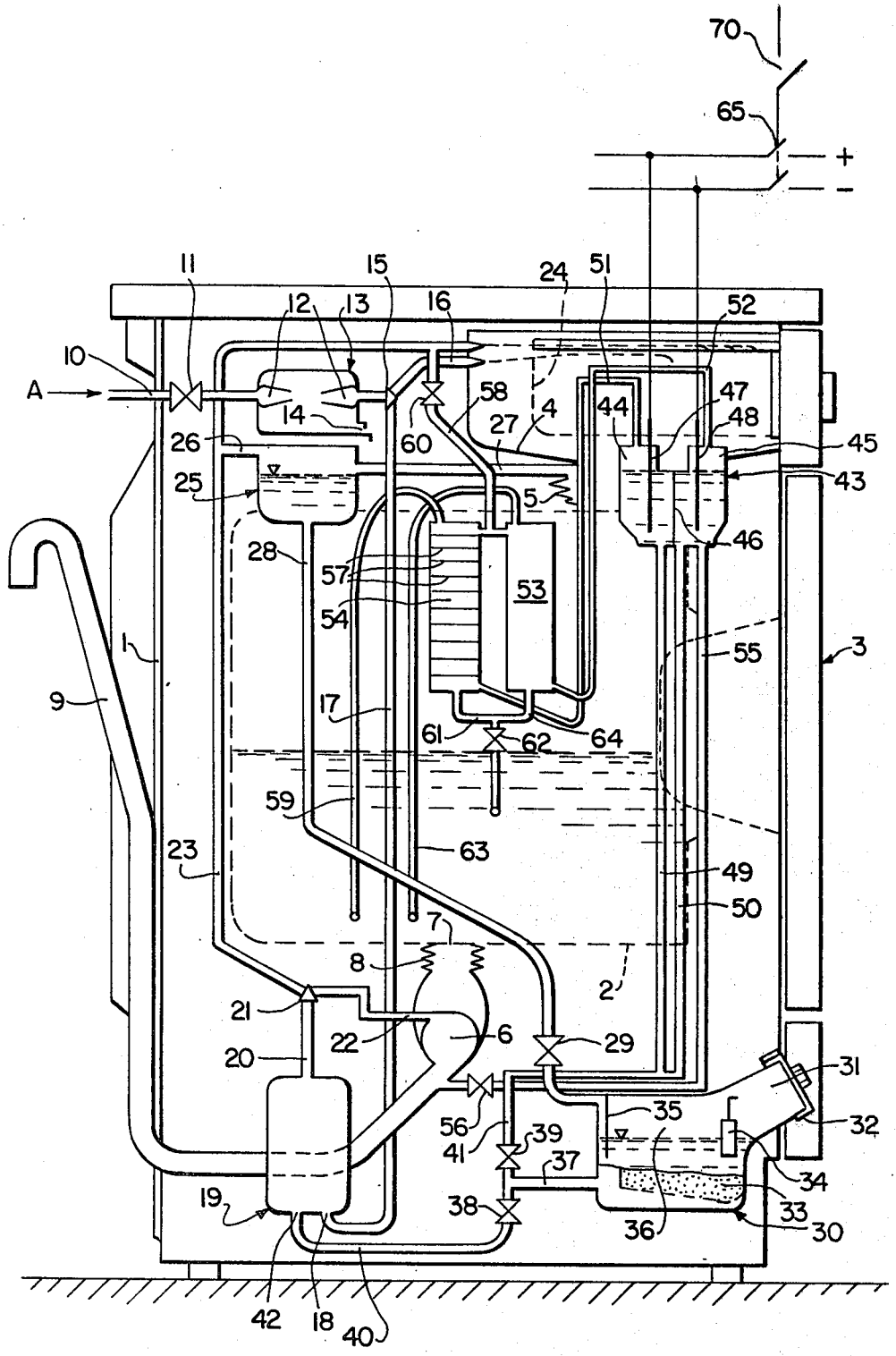
70
65
+
−
11
15
24
51
12
13
16
52
10
A
58
47
14
4
44
48
27
26
60
45
25
5
43
28
46
57
53
54
1
55
3
9
17
61
62
64
59
63
23
49
50
7
8
2
21
22
6
29
20
31
56
35
32
41
39
37
34
19
38
36
33
30
42
18
40

WASHING MACHINE WITH ELECTROCHEMICAL CELL

BACKGROUND OF THE INVENTION

The present invention relates to a domestic washing machine equipped with an electrochemical cell which is capable of generating chlorine gas to be dissolved in water and then to be sent to a washing tub of the machine for achieving a bleaching operation of the laundry therein. The present invention further relates to such a washing machine additionally equipped with a decalcifier or water softener to soften water which is to be used in various stages of the washing cycle.

Known in the art is a washing machine which is equipped with an electrochemical cell capable of producing sodium hypochlorite for achieving bleaching of the laundry, as well as with a decalcifier for softening system water before introduction into the washing tub, and with a salt tank which is supplied with salt, i.e. sodium chloride, and which is fed with system water in order to produce brine.

In such prior art machine, the salt tank can be connected selectively by means of suitable valves either with the electrochemical cell in order to send brine mixed with the system water to the cell, thereby to generate therein sodium hypochlorite by electrolysis, or with the decalcifier in order to regenerate the internal ion exchange resins therein during an operation of regeneration of the decalcifier, thereby to enable the decalcifier again to be able to soften the system water. By this machine it therefore is possible directly to generate sodium hypochlorite to be introduced into the wash tub diluted with water in predetermined proportions at specific stages of the operating program of the machine to achieve a bleaching operation of the laundry and to use detergents of simpler composition which pollute less compared with conventional detergents.

However, although this type of machine operates satisfactory and reliably, such washing machine has certain inherent disadvantages due primary to the provision of the electrochemical cell.

In fact, in order to achieve effective bleaching of the laundry, the electrochemical cell must generate relatively consistent amounts of sodium hypochlorite. However, such actually does not occur due to the construction of the cell necessary to enable a compact machine structure. Thus, the amount of sodium hypochlorite generated during the periods in which the cell is operating is inadequate for the purpose intended. Therefore, in this type of washing machine, the optimal condition required for satisfactory bleaching can be obtained only by using an electrochemical cell of relatively large overall dimensions, particularly horizontally. Such dimensions however, make it difficult and expensive to provide such a cell in the washing machine.

Furthermore, the performance of the electrochemical cell which generates sodium hypochlorite, depends, as is known, on the operating temperature of the cell itself. In particular, in the temperature is slightly above ambient temperatures during electrolysis, the cell will produce relatively smaller amounts of sodium hypochlorite due to the formation of additional compounds, such as chlorates, etc., which have oxidation capabilities higher than sodium chlorite and which therefore are ineffective from the standpoint of achieving bleaching. To prevent the occurrence of such higher temperatures, it would be necessary to cool the cell by means of conventional cooling devices. However, the provision of such cooling devices would further complicate the construction of the machine and would be economically prohibitive.

Still further, the sodium hypochlorite solution which is generated by this type of electrochemical cell contains significant amounts of sodium chloride which, upon entering the washing tub, cause undesirable corrosion of the metallic materials of the tub.

SUMMARY OF THE INVENTION

With the above discussion in mind, it is an object of the present invention to provide a laundry washing machine including an electrochemical cell coupled to a conventional decalcifier, whereby it is possible to overcome the disadvantages of the prior art.

It is a more specific object of the present invention to provide such a washing machine including an electrochemical cell of a type different from that of the prior art washing machines, whereby it is possible to generate chlorine gas by electrolysis of a sodium chloride solution, with the chlorine gas being subsequently absorbed in water and then fed to the washing tub in proper amounts to perform a laundry bleaching operation.

Thus, in accordance with the present invention, sodium hypochlorite no longer is generated, and thereby the disadvantages of the prior art machine requiring an electrochemical cell sufficient for adequate production of sodium hypochlorite are avoided.

Furthermore, in accordance with the present invention, the solution left in the cell following electrolysis, and having high concentrations of sodium chloride, no longer is fed directly to the washing tub, but rather is discharged outwardly, thereby completely avoiding the possibility of damage due to corrosion of the tub materials.

Since in the washing machine according to the present invention there no longer is formation of an alkaline solution, as in the case with the production with of sodium hypochlorite, but rather there is formed a slightly acid solution of "chlorine water" capable of achieving a better bleaching effect on the laundry, it is possible to obtain satisfactory bleaching of the laundry with a smaller amount of active chlorine generated.

Accordingly, in accordance with the present invention, it is possible to use an electrochemical cell of higher performance and smaller overall dimensions. This simplifies the construction of the washing machine, resulting in appreciable economic benefits and in a requirement for a smaller amount of power from a DC supply unit for the electrochemical cell.

More specifically, the above objects and features of the present invention are achieved by the provision of a laundry washing machine including a washing tub, a water supply, a decalcifier for receiving water from the water supply and for discharging softened water, a metering tank at an upper position in the machine for receiving softened water from the decalcifier, a brine tank at a lower position in the machine for receiving softened water from the metering tank and for generating brine, an electrochemical cell for generating chlorine gas, a first valve controlled means for selectively supplying brine from the brine tank to the electrochemical cell, a second valve controlled means for selectively supplying brine from the brine tank to the decalcifier during a stage of regenerated thereof, a discharge extending from a lower portion of the washing tub, a third valve controlled means connecting the electrochemical cell to the discharge, an absorption device connected to the decalcifier to receive therefrom softened water and connected to the electrochemical cell to receive therefrom the chlorine gas, for absorbing the chlorine gas into the softened water, and means for selectively supplying the softened water and absorbed chlorine gas into the washing tub, thereby to perform a bleaching operation.

The washing machine in accordance with the present invention is characterized in that the electrochemical cell is capable of generating chlorine gas and is connected to an absorption device which can be fed with water, thereby to accumulate and absorb the chlorine gas. The absorption device then supplies the absorbed chlorine gas to the washing tub.

BRIEF DESCRIPTION OF THE DRAWING

The above and other objects, features and advantages of the present invention will be apparent from the following detailed description of a preferred embodiment of the present invention, with reference to the accompanying drawing, wherein:

The single FIGURE is a schematic view of a washing machine in accordance with the present invention.

DETAILED DESCRIPTION OF THE INVENTION

With reference now to the drawing, illustrated therein is a washing machine 1 including a washing tub 2 supported in a known manner within the cabinet of the washing machine and internally housing a rotating laundry basket (not shown) capable of holding the laundry to be washed and accessible from a front door 3 of the machine. A detergent feeder or distributor 4 is located in an upper portion of the machine and is equipped with plural compartments capable of containing the appropriate detergents for preliminary washing and washing and the additives required for rinsing of the laundry during the appropriate stages of the washing cycle. The distributor 4 is connected to the tub 2 in a conventional manner, for example through a flexible bellows 5. The machine includes a discharge pump 6 connected with a bottom discharge opening 7 of washing tub 2 through a flexible discharge connection 8 and a discharge pipe 9 connected with the discharge pump 6. System water is fed to the distributor 4 from a water supply source through a water supply pipe 10. Distributor 4 is provided with at least one electric valve 11 or similar valve capable of allowing water to flow or of preventing water from flowing. Valve 11 is connected to a conventional backflow preventing device or pipe separator in the form of venturi tubes 12 located in an upper portion of the machine and capable of imparting a specific kinetic energy to the system water passing therethrough. Tubes 12 are built within a casing 13 located in the upper portion of the machine and equipped with an opening 14 to balance the internal pressure. Casing 13 is able to collect the water originating from the venturi tubes when the kinetic energy of the water is inadequate to traverse between the venturi tubes, for example at the start and at the end of each water charge into the machine, or when there is an inadequate pressure in the water supply system, and to discharge such water into the washing tub in a conventional manner, for example by means of a pipe (not shown).

The outlet of the venturi tube 12, as viewed in the direction of water flow (arrow A), is connected to the inlet of an electric two-way valve 15 or a similar valve. The two outlets of valve 15 are connected to a primary pipe 16 terminating in distributor 4 and to a secondary pipe 17 directed toward a lower portion of the machine and connected to a primary inlet 18 of a decalcifier or water softener 19 of known construction. The purpose of decalcifier 19 is to soften the water from the supply system directed thereto by means of valve 15 to a predetermined value prior to introduction of the water into washing tub 2 during certain stages of the cycle of the washing machine, and in particular prior to the preliminary washing and washing stages, or other stages. Decalcifier 19 has a single outlet 20 connected to the inlet of two-way electric valve 21 or similar valve, the outlets of which are connected to a third pipe 22 connected to discharge pump 6 and to a fourth pipe 23 directed toward the upper portion of the machine and terminating in the distributor 4 adjacent to pipe 16. Pipes 16 and 23 selectively are placed in communication with the compartments provided in a cabinet 24 of distributor 4 by means of a suitable control device of known construction (not shown) and connected to the distributor in order to feed, respectively, unsoftened water and softened water into the compartments of distributor 4.

Additionally, a metering tank 25 is located in an upper portion of the machine, and a pipe 26 connects pipe 23 to metering tank 25 to feed softened water to tank 25. Tank 25 also has an overflow pipe 27 connected to flexible bellows 5 in order to enable metering tank 25 to collect softened water up to a maximum predetermined level and to discharge any excess softened water into tub 2. A pipe 28 extends from the bottom of tank 25 and is connected by means of an electric valve 29 or similar valve to a brine container 30 located in a lower portion of the machine. Brine container or tank 30 is provided with a loading port 31 which can be closed hermetically by means of a removable plug 32 protruding from a lower part of the machine cabinet and accessible from the outside to enable salt, i.e. sodium chloride, 33 to be introduced into tank 30. A programmer of the machine (not shown) controls the opening of electric valve 29, thereby enabling softened water from tank 25 to be discharged in a metered amount into tank 30, into which has been fed previously sodium chloride, thereby to produce brine.

Brine tank 30 may be equipped with a suitable measuring device 34, for example a pipe meter, which is capable of detecting the concentration of the brine within tank 30. Such measuring device is equipped with an indicator (not shown) in order to indicate constantly and prominently the measured values, and thereby to indicate the time at which it is necessary to add additional sodium chloride into tank 30, thereby maintaining the brine concentration as constant as possible. Additionally, brine container 30 is dimensioned to allow the feeding of a predetermined volume of softened water from metering tanks 25 when the electric valve 29 is opened. In such case, to prevent container 30 from filling beyond an overflow level, a vertical partition wall 35 is provided to form an internal air trap 36.

Brine tank 30 has on a side thereof a discharge pipe 37 connected by means of two electric valves 38 and 39 or similar valves with two pipes 40 and 41 connected respectively to a second inlet 42 of decalcifier 19 and to an electrochemical cell 43. Electrochemical cell 43 is supplied with direct current from the electric system of the washing machine to enable cell 43 to produce chlorine gas. Cell 43 is located in an upper portion of the washing machine and can be supplied with brine from tank 30 in a manner to be described in more detail below.

The purpose of electric valves 38 and 39 is to feed selectively brine into decalcifier 19 during a stage of regeneration of the ion exchange resins therein or into electrochemical cell 43 in a manner to be described in more detail below. Cell 43 in turn produces chlorine gas by electrolysis of this brine solution, and this production is performed only during specific stages of the cycle of the operation of the machine.

Cell 43 is equipped with at least two compartments 44 and 45 separated by means of a partition baffle 46 or similar partition device made of a suitable porous material which is resistant to the corrosive action of chlorine, for example a plastic material. Compartments 44 and 45 are equipped with an anode 47 and a cathode 48, respectively, such that compartments 44 and 45 respectively form anode and cathode compartments. Compartments 44 and 45 are connected at lower portions thereof to pipe 41 by means of separate pipes 49 and 50, respectively. Upper portions of compartments 44 and 45 are connected by respective separate pipes 51 and 52 with lower portions of respective storage or absorption containers 54 and 53, the function of which will be described in more detail below. A pipe 55 is connected to a lower portion of cathode compartment 45 and to the discharge connection 8 by means of an electric valve 56 or a similar valve.

The modes of feeding of the brine solution into the cell 43 and the discharge of the electrolysis solution remaining in cathode compartment 45 at the end of the electrolysis operation are apparent. To feed cell 43 with the brine contained in tank 30, it is necessary firstly to control the opening of electric valve 29 while maintaining electric valve 38 closed, and then to control the opening of electric valve 39. Accordingly, softened water contained in metering tank 25 is fed into brine container 30, and then brine solution is fed from container 30 via pipe 37, electric valve 39, pipe 41 and pipes 49 and 50 into anode and cathode compartments 44 and 45 of cell 43, by hydrostatic pressure. Cell 43 is located in the machine at a height to enable its proper filling upon reaching a hydrostatic balance between cell 43 and metering tank 25. In order to make it possible to load brine solution into both compartments 44 and 45, for the purpose of always maintaining electrodes 47 and 48 relatively immersed, as well as to maintain porous baffle 46 within the brine solution to perform electrolysis, the cell 43 is constructed of a suitable shape to allow only limited variations of the brine level in the two compartments 44 and 45. Thus, the level of the brine solution in the two compartments of the cell is maintained generally equal so as to prevent the occurrence of a difference of hydrostatic pressure which might jeopardize the proper operation of the entire hydraulic system of the machine.

The residual solution resulting from the electrolysis operation and contained in the cathode compartment 45 is discharged from cell 43 by opening the electric valve 56, thus allowing such solution to pass through pipe 55 and to be discharged outwardly through the discharge pump 6. There are a number of reasons for discharging such solution in this manner. Initially, since this solution still contains considerable amounts of sodium chloride which would damage the metallic materials of the washing tub, it follows that the outward discharge of such solution will prevent such damage from occurring. Also, due to the fact that the anode and cathode compartments of the cell operate under acidic and basic conditions, respectively, the brine fed into the electrochemical cell still may contain limited amounts of various types of salts, for example calcium and magnesium salts, due to inadequate softening of the supply of water or due to the use of impure sodium chloride. It is possible that these salts may be deposited inside the cathode compartment of the cell as well as on the cathode surface of the porous baffle 46. Under such conditions, the cell would operate unsatisfactorily, thus shortening its life.

In order to obviate these disadvantages, in accordance with the present invention, at the end of an electrolysis operation, first of all the basic solution contained in cathode compartment 45 is discharged via pipe 55 and valve 56, as mentioned above. Therefore, as soon as this operation is completed, there occurs a slow percolation through the porous baffle 46 of the acid solution contained in anode compartment 44 until the acid solution penetrates completely into the cathode compartment 45 and is in turn discharged outwardly. In this manner, in addition to allowing an effective emptying of both compartments of the electrochemical cell 43, a satisfactory descaling of the salts deposited on the cathode surface of porous baffle 46 is achieved during such percolation of the acid solution through the baffle. Thereby, the cell operates under satisfactory conditions.

Subsequently, the cell is washed with softened water originating from pipe 23, i.e. through an electric valve 60 in a line 58 between pipe 23 and containers 53 and 54, while maintaining an electric valve 62 closed. These pipes and valves will be discussed in more detail below. Obviously, at this stage electric valve 39 is closed while electric valve 56 is opened for the above discharged operation.

During operation of cell 43 during electrolysis, chlorine gas and hydrogen gas are formed in anode and cathode compartments 44 and 45, respectively. Such gases pass through pipes 51 and 52 respectively and bubble into water contained in absorption containers 54 and 53, respectively.

Preferably, container 54 has a parallelepiped configuration with a vertical development. Container 54 can however be of other shapes and can be provided with a horizontal development or can be tilted in any suitable manner. Container 54 is equipped internally with a plurality of horizontal partition walls 57 which are perforated and which are positioned one above the other. Pipe 58 connects pipe 23 with an upper portion of container 54, and also with an upper portion of container 53. Accordingly, by opening valve 60, softened water is supplied to containers 54 and 53. An upper portion of container 54 also has connected thereto a pipe 59 which empties into washing tub 2 at a level therein equal to or lower than the filling level of water therein, for a reason to be described in more detail below. To the bottom portion of container 54 is connected a pipe 61 having therein electric valve 62 or a similar valve and connected to tub 2 at a level therein equal to or lower than the water filling level therein.

Container 53 can be of the same shape as container 54, or of various different shapes but of the same height. Container 53 is not provided with partition walls such as walls 57 of container 54.

A pipe 63 is connected to an upper portion of container 53 and is connected to tub 2 at the same level as pipe 59. A pipe 64 is connected to a bottom portion of container 53 and to pipe 61 at a position upstream of electric valve 62. Accordingly, upon opening of valve 60, softened water is fed through pipes 23 and 58 into containers 54 and 53 which, therefore, are filling simultaneously to the same level. Then, electrochemical cell 43 is fed, with the result that chlorine and hydrogen gases generated therein form in the upper sections of compartments 44 and 45, from which such chlorine and hydrogen gases pass to the lower sections of containers 54 and 53, respectively. Particularly, within container 54 the chlorine gas is gradually absorbed by the water contained therein. Such process is facilitated by the presence of the perforated partition walls 57 which are provided with holes of dimensions such as to promote the formation of small diameter chlorine gas bubbles which dissolve more readily in the water.

The amount of softened water supplied into container 54 is selected to be such as to allow, within a predetermined period of time, the absorption of an amount of chlorine gas sufficient to ensure an effective bleaching of the laundry without damage thereto. The hydrogen in turn gradually passes through container 53, pipe 63, and tub 2 without being absorbed by the water and then is discharged to the atmosphere. In this manner, during this phase of the cycle of the washing machine, the hydrostatic pressures in containers 54 and 53, as well as in compartments 44 and 45, always are maintained at an equilibrium, thus ensuring proper operation of the entire cell-container assembly. Additionally, since the chlorine gas and the hydrogen gas always are kept separated from each other, any possible accidental and potentially dangerous contact therebetween is prevented, thus resulting in a positive safety. As mentioned above, container 54 also is connected to tub 2 through pipe 59. Hence, if there is an excess amount of chlorine gas in container 54 which is not absorbed by the water in the above-described manner, this excess chlorine gas will be discharged into tub 2 and will be absorbed completely by the water therein. Any loss of chlorine gas outside the machine thus is avoided, thereby preventing with certainty disadvantages resulting from the presence of chlorine in the air, for example foul odor, etc.

From the foregoing, it follows that during the time the electrochemical cell 43 is operated and generates chlorine gas, it is necessary for tub 2 to be filled with water so as always to ensure the above-discussed safety conditions. In accordance with the present invention, the electric supply circuit of electrochemical cell 43 is connected to a switch 65 which is connected to a means, for example a machine pressure switch 70, capable of monitoring and/or controlling the water level in tub 2. Pressure switch 70 is calibrated to bring about closing or opening of switch 65 upon the occurrence of predetermined higher or lower levels of the water in tub 2, sufficient to guarantee absorption of the chlorine gas even in the event of breakdown in the hydraulic supply circuit of the machine, or if there is an undesirable emptying of the water in container 54. When a predetermined chlorine concentration has developed in the water in container 54, the electrical supply of cell 43 is cut off, with the result that the machine is ready for a bleaching operation. At this stage of the cycle, electric valve 62 is opened so that the chlorine absorbed in the water in container 54 is introduced into the water of tub 2. Then, in order to eliminate any possible residual chlorine gas remaining in container 54, electric valve 60 again is opened, and the water entering the container 54 will completely absorb such residual chlorine gas and feed it into tub 2. To ensure that during this stage the chlorine absorbed in the water is introduced only into tub 2, and is not introduced into compartments 44 and 45 of cell 43 through pipes 51 and 52, respectively, cell 43 is placed at a higher position within the machine than is container 54. Although cell 43 and containers 54 and 53 are shown as separate elements, it is to be understood to be within the scope of the present invention that cell 43 and containers 54 and 53 could be formed integrally, for example by injection molding of a suitable plastic material, thereby obtaining a single compact construction unit which can easily be installed in the machine.

As discussed above, brine container 30 also may be connected with inlet 42 of decalcifier 19 by opening electric valve 38 and by closing electric valve 39, so that brine is supplied from container 30 to decalcifier 19 to regenerate the ion exchange resins in decalcifier 19. In such case, electric valve 29 again is opened, with the result that the softened water contained in metering tank 25 is conveyed to container 30, and by hydrostatic pressure will move the resultant brine solution to decalcifier 19.

Feeding of brine container 30 with softened water in the manner and for the purpose as described above is a vital condition to prevent the brine from containing excessive amounts of calcium carbonate which would gradually deposit in the electrochemical cell, thereby deleteriously effecting the proper functioning thereof.

It will be apparent from the above that the washing machine according to the present invention is able to perform automatically the various stages of the operating cycle of the washing machine, opening and closing all of the above-discussed electric valves, according to predetermined sequences by means of at least one suitable control device provided in the machine, for example a programmer-timer of known construction. Since such programmer-timer is contemplated to be any such known device, it will not be described in detail herein. Moreover, the construction of the present invention makes it possible to selectively feed brine from brine container 30 to decalcifier 19 or to electrochemical electrochemical cell 43 due solely to the hydrostatic pressure of the softened water in metering tank 25. This eliminates the necessity of the provision of any other additional regulating or supply device and simplifies the hydraulic circuit of the machine.

A complete washing cycle of the washing machine according to the present invention now will be described. This cycle consists essentially of the following main stages: cleaning of the decalcifier, filling of the containers 53 and 54, preliminary washing, washing, rinsing, and laundry spinning. Prior to starting the cycle, it is necessary to introduce a specific amount of pure sodium chloride into brine tank 30, or to check the amount of sodium chloride left over from a previous cycle, when the machine is operated for the first time or after it already has performed various wash cycles. Also, it is necessary to feed the prewash and wash detergents, as well as softeners or sizers, into the respective compartments of distributor 4. The washing machine, at the start of a new cycle thereof, is preset as follows. The decalcifier 19 is in the regeneration stage and contains that brine fed at the end of the previous cycle. Containers 53 and 54 and metering tank 25 are empty. The stages of the complete cycle of the washing machine are carried out as follows.

Cleaning of the decalcifier:

This stage is carried out in order to discharge the solution for regeneration formed in the decalcifier 19 at the end of the preceding cycle. This solution is obtained from the regeneration of the ion exchange resins contained in the decalcifier by the brine. To accomplish this cleaning, the supply system water is passed by electric valve 15 into pipe 17 and through inlet 18 into decalcifier 19. Such supply system water cleans the solution remaining in decalcifier 19 from the regeneration of the preceding cycle and passes such solution through outlet 20, electric valve 21, pipe 22, discharge pump 6 and exhaust pipe 9.

Filling of the containers:

This is performed by introducing the supply system water into the machine by opening electric valve 11 and passing the water through venturi 12, valve 15, pipe 17 and inlet 18 into decalcifier 19, thereby softening the water. The softened water then passes from outlet 20, electric valve 21 and pipe 23. The softened water fills metering tank 25 to the overflow level. Such softened water also is introduced into washing tub 2 through distributor 4. Additionally, valve 60 is opened, such that the softened water passes through pipe 58 and fills containers 54 and 53 with softened water at a predetermined level to ensure proper operation of the machine. If excessive amounts of softened water are fed, any surplus is discharged into tub 2 through pipes 59 and 63 of containers 54 and 53, respectively. Electric valves 29 and 39 then are opened, whereby softened water from metering tank 25 passes into brine tank 30, thereby forming brine, and this brine is passed by hydrostatic pressure through pipe 37, valve 39, pipe 41 and pipes 49 and 50 into compartments 44 and 45 of cell 43.

Generation of chlorine gas:

This stage starts when the filling of containers 53 and 54 and cell 43 has been completed and when tub 2 has been filled with water to a predetermined level. Under these conditions, as previously described, the machine pressure switch 70 closes the switch 65, thus allowing electric supply to the electrochemical cell 43. Switch 70 also opens switch 65 at any time the water level in tub 2 falls below a predetermined value. Cell 43 constantly and continuously is fed to produce chlorine gas during development of the successive stages of the cycle of the washing machine, as will be described in more detail below.

Prewash:

This is achieved, when called for by the program of the machine, by feeding softened water into the tub, as described above, and maintaining electric valve 60 closed. This softened water then passes through the distributor 4 and through the appropriate prewash compartments introduces the prewash detergent into the tub 2. The laundry prewashing operation then is performed in a conventional manner and terminates with discharge in a normal manner. By using softened water, it is possible during this prewash stage to use smaller quantities of detergents having simpler composition than detergents used in prewash with unsoftened water, still achieving satisfactory treatment of the laundry. Particularly, the prewash detergent need not contain perborate which is inactive during this stage due to the low temperatures of the water. The production of chlorine gas by cell 43 continues during this stage.

Wash:

This stage takes place in the same manner as the prewash stage, except for the fact that the softened water is fed to the wash compartment of the distributor 4, resulting in the feeding of the appropriate wash detergent into the tub 2. At the end of this stage, additional softened water is fed into the tub 2 in order to gradually cool the laundry to a given temperature, in a known manner. Then, after the laundry has been washed, the bath is discharged completely. During this stage, as in the prewash stage, it is possible to use smaller amounts of detergents having a simpler composition. Also, during the wash stage production of chlorine gas in cell 43 continues.

Rinsing:

Rinsing is performed by feeding unsoftened water into the tub 2, except during the rinse during which bleaching occurs and except during the last rinse, during which softened water is fed. This water is discharged when the particular rinse operation is completed. In particular, during one of the rinse stages bleaching takes place. During such rinsing stage, the electric supply to cell 43 is interrupted, and the chlorine solution contained in tank 54 is fed to tub 2 by opening electric valve 62. At the same time, any residual chlorine gas still remaining in container 54 is fed into tub 2 via pipe 59. The electrochemical cell 43 is completely emptied with appropriate washing of the porous baffle 46 to remove any scale therefrom, as well as subsequent rinsing of the cell. These operations occur in the manner described above. Thus, a predetermined amount of chlorine gas is produced in cell 43 for the purposes mentioned above, making any handling of the chlorine gas by the operator unnecessary during the cycle of the washing machine. Finally, during the last rinse, the softened water is sent through the appropriate compartment of the distributor 4, removing the softener or sizer that may be contained in order to feed it into the tub 2.

Spinning:

This is performed in a conventional manner, and upon completion of spinning, all the water contained in tub 2 is discharged. At the end of each cycle, the ion exchange resins contained in the decalcifier 19 are regenerated. To do this, the brine is fed from container 30 into the decalcifier 19 in the manner described above.

A washing machine designed in the above-described manner offers the advantages described above combined with the use of chlorine gas and a cell sufficient to produce such gas. Additionally, since pipe 22 of decalcifier 19 is connected directed to the suction side of exhaust pump 6, it follows that during each decalcifier cleaning stage the regeneration solution is discharged externally, thereby preventing it from entering the tub 2 and creating corrosion hazards for the tub. Furthermore, the use of detergents of a simpler composition and containing small amounts of complexing and bleaching agents enables the elimination of pollution of the effluent from the machine, thereby resulting in considerable ecological advantages.

Although the present invention has been described and illustrated with regard to specifically preferred structural features thereof, it is to be understood that various changes and modifications may be made without departing from the scope of the present invention.

We claim:

1. A laundry washing machine comprising:

a washing tub;

water supply means;

decalcifying means for receiving water from said water supply means and for discharging softened water;

a metering tank at an upper position in the machine for receiving softened water from said decalcifying means;

brine tank means at a lower position in the machine for receiving softened water from said metering tank and for generating brine;

an electrochemical cell for generating chlorine gas;

first means for selectively supplying brine from said brine tank means to said electrochemical cell;

second means for selectively supplying brine from said brine tank means to said decalcifying means during a stage of regeneration thereof;

a discharge extending from a lower portion of said washing tub;

third means connecting said electrochemical cell to said discharge;

absorption means connected to said decalcifying means to receive therefrom softened water and connected to said electrochemical cell to receive therefrom said chlorine gas, for absorbing said chlorine gas in said softened water; and means for selectively supplying said softened water and absorbed chlorine gas into said washing tub, thereby to perform a bleaching operation.

2. A washing machine as claimed in claim 1, wherein said absorption means comprises a storage container equipped with a plurality of perforated horizontal partition walls, positioned one above the other, and said means for supplying softened water and absorbed chlorine gas comprises a lower pipe connected to the bottom of said storage container and connected, via a valve, to said washing tub at a level equal to or lower than the water filling level therein, and an upper pipe connected to the top of said storage container and connected to said washing tub at a level equal to or lower than the water filling level therein.

3. A washing machine as claimed in claim 2, further comprising an additional storage container free of partition walls, a lower pipe connected to the bottom of said additional storage container and connected to said lower pipe from said storage container at a position upstream of said valve, and an upper pipe connected to the top of said additional storage container and connected to said washing tub at a level equal to or lower than the water filling level therein.

4. A washing machine as claimed in claim 3, wherein said electrochemical cell has anode and cathode compartments, and further comprising means for connecting upper portions of said anode and cathode compartments to lower portions of said storage container and said additional storage container, respectively.

5. A washing machine as claimed in claim 4, wherein said electrochemical cell is located at a level above said storage containers.

6. A washing machine as claimed in claim 4, wherein said third means is connected solely to said cathode compartment.

7. A washing machine as claimed in claim 1, wherein said electrochemical cell includes anode and cathode compartments, and said third means is connected solely to said cathode compartment.

8. A washing machine as claimed in claim 1, further comprising switch means for connecting said electrochemical cell to an electric source, and means for controlling the level of water filled into said washing tub, said switch means being coupled to said controlling means such that said electrochemical cell is prevented from operating unless water is filled into said washing tub to a predetermined level.

9. A washing machine as claimed in claim 1, further comprising a detergent distributor connected to said washing tub for supplying thereto detergent and additive substances, means for supplying softened water from said decalcifying means to said distributor, and to said absorption means via a valve.

* * * * *